US005899342A

United States Patent [19]

Livsey

[11] Patent Number: 5,899,342

[45] Date of Patent: May 4, 1999

[54] HYDROCYCLONE SEPARATOR

[75] Inventor: James D. Livsey, Rochester, Mass.

[73] Assignee: Voith Sulzer Paper Technology North America, Inc., Mansfield, Mass.

[21] Appl. No.: 08/868,628

[22] Filed: Jun. 4, 1997

[51] Int. Cl.[6] ..... B03B 5/34

[52] U.S. Cl. ..... 209/725; 210/512.1

[58] Field of Search ..... 209/722, 725, 209/726, 733, 734; 210/512.1, 512.2

[56] References Cited

U.S. PATENT DOCUMENTS

| | | | |
|---|---|---|---|
| 2,518,084 | 8/1950 | Smith | 209/725 |
| 2,655,263 | 10/1953 | Chisholm | 209/725 |
| 3,501,001 | 3/1970 | Muller et al. | 209/725 X |
| 4,134,828 | 1/1979 | Trawinski | 209/733 X |
| 4,175,036 | 11/1979 | Frykhult | 209/734 |
| 5,770,050 | 6/1998 | Trefz et al. | 209/725 X |

*Primary Examiner*—Boris Milef
*Attorney, Agent, or Firm*—Samuels, Gauthier & Stevens

[57] ABSTRACT

An apparatus for separating relatively light fractions from relatively dense fractions in a pulp suspension. The apparatus has a tubular housing of circular cross section defining a separation chamber extending longitudinally from an inlet end to an outlet end, with an inlet at the inlet end for tangentially introducing a flow of the pulp suspension into the housing for vortical flow along the length of the separation chamber towards the outlet. The vortical flow effects a separation of the relatively light fraction from the relatively dense fraction. The housing has at least two outlets at the outlet end, one outlet being positioned to accommodate an exiting flow of the relatively light fraction and the other outlet being positioned to accommodate an exiting flow of the relatively dense fraction. The diameter of the separation chamber at an intermediate region along its length is enlarged in comparison to its diameter at the inlet and outlet ends.

6 Claims, 2 Drawing Sheets

HYDROCYCLONE SEPARATOR

BACKGROUND OF THE INVENTION

1. Field of the Invention

The present invention relates to an apparatus commonly referred to as a "hydrocyclone" used to separate a light fraction from a liquid/solid suspension.

2. Description of the Prior Art

Hydrocyclones are commonly used to separate contaminants from liquid/solid suspensions, e.g. pulp/water suspensions. The suspension enters the hydrocyclone through an inlet disposed tangentially to the interior wall of a longitudinally extending separation chamber. The inlet pressure creates a high inlet velocity which in turn sets up a free liquid vortex within the chamber with a central air core. Centrifugal forces act on the liquid and solids resulting in a separation based on their relative densities. The size and shape of the solids, the geometry of the hydrocyclone, and the properties of the liquid will also significantly affect the efficiency of the separation. The hydrocyclone will have at least two outlets from the separation chamber, one outlet being positioned to accommodate an outflow of the less dense fraction and the other outlet being positioned to accommodate the outflow of the higher density fraction. Many hydrocyclones are designed to create a separation, from the suspension, of the denser fraction. Other hydrocyclones have been to designed to remove the less dense fraction from the suspension.

SUMMARY OF THE INVENTION

A general object of the present invention is to provide a hydrocyclone capable of improved performance as compared to conventional hydrocyclones of the type currently in use.

A more specific object of the present invention, when processing pulp/water suspensions, is to achieve a reduction of useful papermaking fibers in the flow from the reject outlet.

A companion objective of the present invention is to achieve a higher throughput for a given pressure drop between the inlet and the accept outlet of the hydrocyclone.

The hydrocyclone of the present invention is designed to separate contaminants having a specific gravity of less than 1.00, from a papermaker's pulp/water suspension. Such contaminants typically include many plastics, waxes and adhesives that enter the pulp stream during the recycling of waste paper.

The hydrocyclone has a tubular housing of circular cross section defining a separation chamber extending longitudinally from an inlet end to an outlet end. An inlet at the inlet end tangentially introduces a flow of the pulp/water suspension into the housing for vortical flow along the length of the suspension chamber towards the outlet end. The vortical flow effects a separation of the relatively light fraction from the relatively dense fraction. The relatively dense fraction exits the separation chamber through an "accepts" outlet, and the relatively light fraction exits the separation chamber through a "rejects" outlet. The accepts and rejects outlets are located at the opposite end of the separation chamber from the tangential inlet.

For discussion purposes, the separation chamber may be subdivided into an inlet portion extending from the tangential inlet to an intermediate region along the longitudinal chamber axis, and an outlet portion beginning at the intermediate region and extending to the outlet end. The diameter of the inlet portion increases gradually from the inlet to the intermediate region, and the diameter of the outlet portion decreases gradually from the intermediate region to the outlet end.

In a preferred embodiment of the invention, the tubular housing is defined by two truncated conical sections joined together at their large diameter ends, with the changes in the diameter of the separation chamber being linear.

In other embodiments of the invention, the tubular housing is subdivided into mating portions which vary the diameter of the separation chamber in a non-linear relationship.

These and other objects, features and advantages of the present invention will become more apparent as the description proceeds with the aid of the accompanying drawings, wherein:

DETAILED DESCRIPTION OF THE ILLUSTRATED EMBODIMENTS

Figure 1:
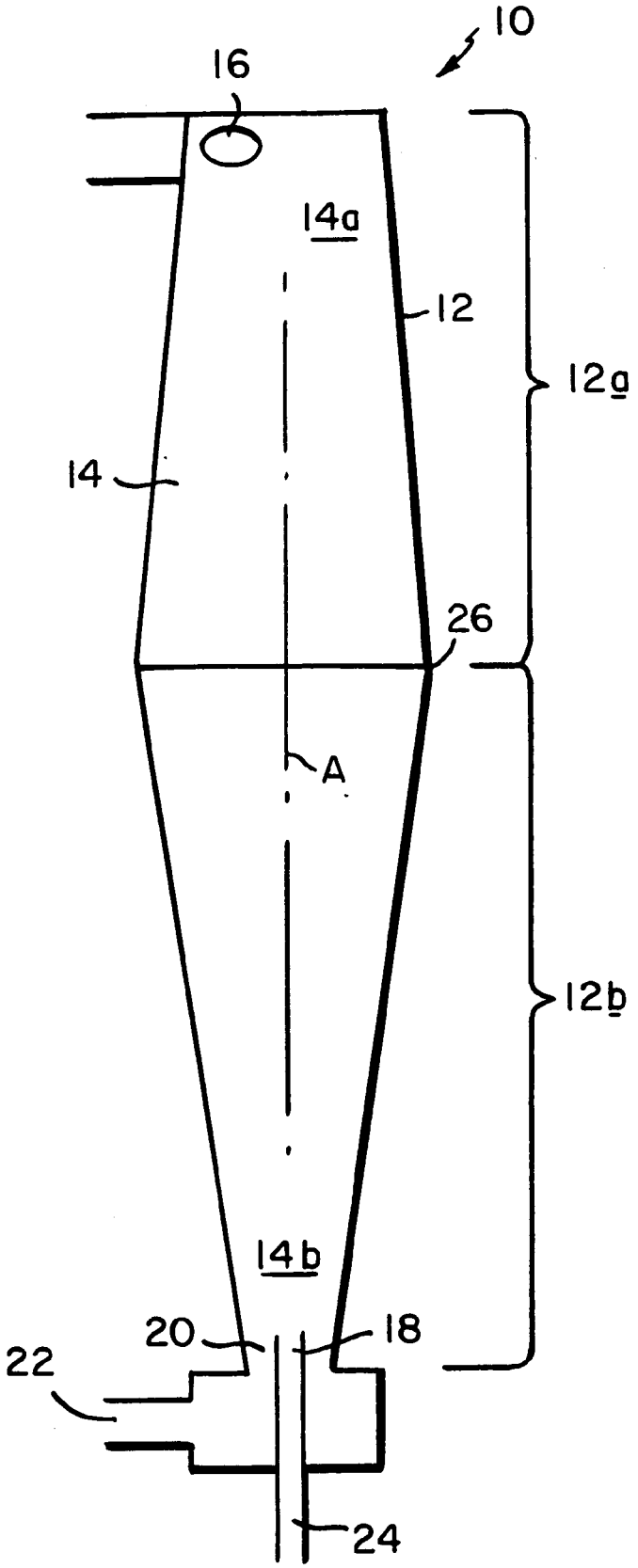
FIG. 1 is a diagrammatic longitudinal sectional view taken through one embodiment of a hydrocyclone in accordance with the present invention.

With reference initially to FIG. 1, a hydrocyclone apparatus in accordance with a preferred embodiment of the present invention is generally depicted at 10. The apparatus includes a tubular housing 12 of circular cross section defining a separation chamber 14. The separation chamber extends longitudinally from an inlet end 14*a* to and outlet end 14*b*. An inlet 16 is disposed tangentially to and in communication with the inlet end 14*a* of the separation chamber. A reject outlet 18 and an accept outlet 20 are disposed concentrically at the outlet end 14*b* of the separating chamber. The accept outlet 20 leads to an accept nozzle 22 having an axis that may be disposed either parallel or perpendicular to the longitudinal axis A of the separation chamber 14. Likewise, the reject outlet 18 leads to a reject nozzle 24 which may be similarly disposed with respect to the longitudinal axis A.

The housing 12 has an inlet portion 12*a* leading from the inlet end 14*a* of the separation chamber to an intermediate region 26, and an outlet portion 12*b* leading from the intermediate region to the outlet end 14*b* of the separation chamber. The diameter of the separation chamber 14 in the inlet portion 12*a* increases gradually from the inlet end 14*a* to the intermediate region 26. The diameter of the separation chamber in the outlet portion 12*b* decreases gradually from the intermediate region 26 to the outlet end 14*b*.

The inlet and outlet housing portions 12*a*, 12*b* comprise truncated conical sections, with their larger diameter bases joined one to the other at the intermediate region 26, and with the changes in their internal diameters being linear.

The pulp suspension enters the entry end 14*a* of the separating chamber tangentially via inlet 16, thereby setting up a free vortex in the separation chamber. The pulp suspension moves in the longitudinal direction towards the outlet end 14*b*, passing first through the housing section 12*a* and then through the housing section 12*b*. The heavier fraction of the pulp suspension will exit the separation chamber 14 via the accept outlet 20 and communicating nozzle 22. The lighter fraction of the pulp suspension will exit the separation chamber through the reject outlet 18 and communicating nozzle 24.

The above described housing and separation chamber configuration has been shown to provide improved results over conventional hydrocyclones having separation chambers with either cylindrical inlet portions or separation chambers with diameters which constantly decrease toward the outlet end.

Of particular significance is the ability of the present invention to achieve a reduction of useful papermaking fibers in the flow from the reject outlet. In addition, a higher throughput for a given pressure drop from the inlet to the accept outlet may be achieved. These advantages are indicative of a flow through the apparatus having a more stable vortex and a straighter core.

Figure 2:
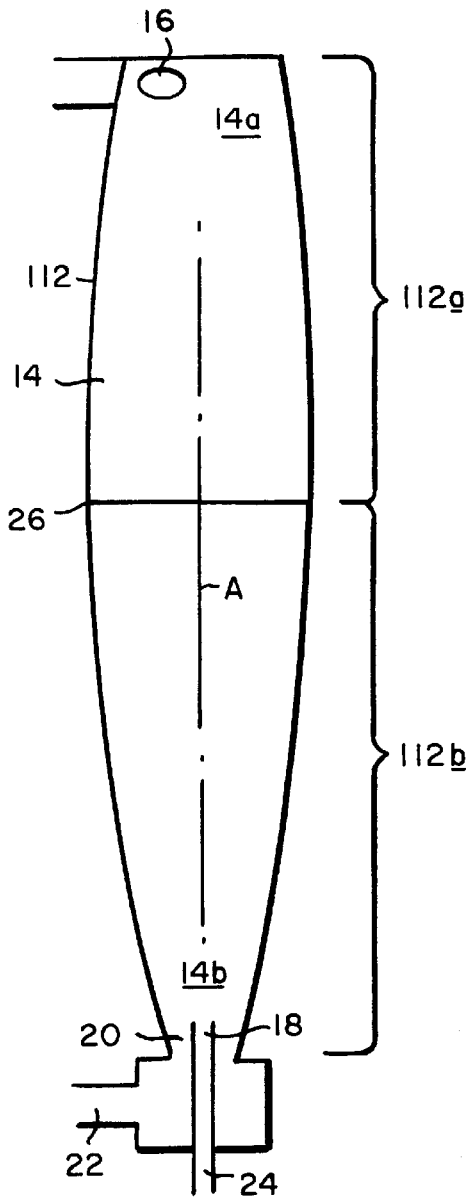
FIGS. 2 and 3 are similar views showing alternative embodiments of hydrocyclones in accordance with the present invention.

FIG. 2 is a cross-sectional view similar to FIG. 1 showing an alternative embodiment of the invention wherein the inlet and outlet portions 112*a*, 112*b* of the housing 112 are curved to provide gradual but non-linear changes in the diameter of the separation chamber 14.

Figure 3:
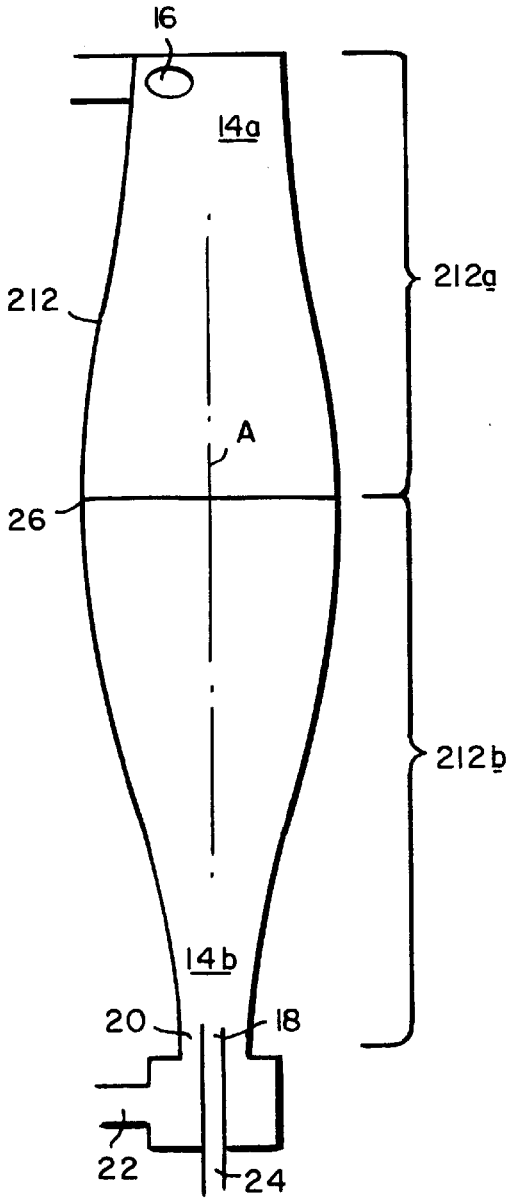

FIG. 3 illustrates another embodiment of the invention wherein the inlet and outlet portions 212*a*, 212*b* have different curvatures, again providing non-linear variations for the diameter of the separation chamber 14.

While the embodiments shown in FIGS. 1–3 have different configurations, they each share a common characteristic, namely, that the diameter of the separation chamber at an intermediate region along its length is enlarged in comparison to the diameter of the separation chamber at the inlet and outlet ends.

It is my intention to cover these and any other modifications or variations encompassed by the scope of the claims appended hereto.

I claim:

1. Apparatus for separating a relatively light fraction of a pulp suspension from a relatively dense fraction of said pulp suspension, said apparatus comprising:

a tubular housing of circular cross section defining a separation chamber extending longitudinally from an inlet end to an outlet end, the diameter of said separation chamber at an intermediate region along the length thereof being enlarged in comparison to the diameter of said separation chamber at said inlet and outlet ends;

an inlet at said inlet end for tangentially introducing a flow of said pulp suspension into said housing for vortical flow along the length of said separation chamber towards said outlet end, said vortical flow effecting a separation of said relatively light fraction from said relatively dense fraction; and accept and reject outlets for receiving the separated fractions of said pulp suspension at the outlet end of said separation chamber, said reject outlet being aligned with the longitudinal axis of said separation chamber to receive said relatively light fraction, and said accept outlet being disposed radially outwardly from said reject outlet to receive said relatively dense fraction.

2. The apparatus as claimed in claim 1 wherein the diameter of said separation chamber increases gradually from said inlet end to said intermediate region, and decreases gradually from said intermediate region to said outlet end.

3. The apparatus as claimed in claim 2 wherein the changes in separation chamber diameter are linear.

4. The apparatus as claimed in claim 2 wherein the changes in separation chamber diameter are non-linear.

5. The apparatus as claimed in claim 1 wherein said housing is defined by two hollow truncated conical sections joined one to the other at said intermediate region.

6. A hydrocyclone apparatus for separation of a light fraction of a pulp suspension from a denser fraction of said suspension, comprising:

a separation chamber;

an inlet means disposed at an inlet end of said separation chamber for introducing said pulp suspension into said separation chamber; and at least two outlet means disposed at an opposite outlet end of said separation chamber for removal of the separated fractions of said pulp suspension;

the diameter of said separation chamber increasing gradually from said inlet end to an intermediate region and then decreasing gradually from said intermediate region to said outlet end.

* * * * *